US011359776B2

(12) United States Patent
Wang et al.

(10) Patent No.: US 11,359,776 B2
(45) **Date of Patent: *Jun. 14, 2022**

(54) LINEAR LUMINAIRE

(71) Applicant: Hubbell Lighting, Inc., Shelton, CT (US)

(72) Inventors: Yue Wang, West Covina, CA (US); Kevin Lu, Fountain Valley, CA (US); Syed Raza, Rancho Palos Verdes, CA (US); Dean Dal Ponte, Glendale, CA (US); Steve Eastwood, Los Angeles, CA (US); George Guerra, Chino Hills, CA (US); Paul Lewis, Greenville, SC (US); Prathika Appaiah, Pasadena, CA (US)

(73) Assignee: Hubbell Lighting, Inc., Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/145,978

(22) Filed: Jan. 11, 2021

(65) Prior Publication Data

US 2021/0356086 A1 Nov. 18, 2021

Related U.S. Application Data

(63) Continuation of application No. 16/876,873, filed on May 18, 2020, now Pat. No. 10,907,783.

(51) Int. Cl.
*F21S 4/28* (2016.01)
*F21V 5/04* (2006.01)
(Continued)

(52) U.S. Cl.
CPC ..... *F21S 4/28* (2016.01); *F21V 5/048* (2013.01); *F21V 15/015* (2013.01); *F21Y 2103/10* (2016.08); *F21Y 2115/10* (2016.08)

(58) Field of Classification Search
CPC ..... F21V 5/048; F21V 15/015; F21V 17/107; F21V 17/18; F21Y 2103/10; F21S 4/28; F21S 41/20
(Continued)

(56) References Cited

U.S. PATENT DOCUMENTS 2,329,435 A 9/1943 Colucci
2,362,091 A 11/1944 Parlato
(Continued)

FOREIGN PATENT DOCUMENTS

CN 108779898 * 11/2018

OTHER PUBLICATIONS

Translation of CN 108779898 (2018) (Year: 2021).*
PCT/US2020/033424 International Search Report and Written Opinion dated Aug. 26, 2020.

*Primary Examiner* — Lau K Tso
(74) *Attorney, Agent, or Firm* — Michael Best & Friedrich LLP

(57) ABSTRACT

A luminaire including a housing, a light emitter supported by the housing, and a cover removably coupled to the housing, where the cover includes a lens substantially covering the light emitter. An end cap is removably coupled to the housing and positioned substantially flush with the lens. A coupling mechanism couples the end cap to the housing, where the end cap substantially covers the coupling mechanism while coupled to the housing.

18 Claims, 14 Drawing Sheets

(51) Int. Cl.
*F21V 15/015* (2006.01)
*F21Y 103/10* (2016.01)
*F21Y 115/10* (2016.01)

(58) Field of Classification Search
USPC ..... 362/249.01, 217.1, 374, 375
See application file for complete search history.

(56) References Cited

U.S. PATENT DOCUMENTS

| | | | | |
|---|---|---|---|---|
| 4,580,200 | A | 4/1986 | Hess et al. | |
| 5,172,976 | A | 12/1992 | Bogdanovs | |
| 5,311,414 | A | 5/1994 | Branham, Sr. | |
| 5,803,588 | A | 9/1998 | Costa | |
| 5,816,687 | A | 10/1998 | Tapp | |
| 6,467,928 | B2 | 10/2002 | Crelin | |
| 7,114,833 | B1 | 10/2006 | Pickei, I | |
| 7,980,721 | B2 | 7/2011 | Gray | |
| 8,092,040 | B2 | 1/2012 | Wu | |
| 9,476,550 | B2 | 10/2016 | McCarthy et al. | |
| 10,054,296 | B2 | 8/2018 | Chamberlain | |
| 10,907,783 | B2 * | 2/2021 | Wang | F21V 15/015 |
| 2009/0021936 | A1 | 1/2009 | Stimac et al. | |
| 2014/0247603 | A1 | 9/2014 | Cruz | |
| 2018/0363886 | A1 * | 12/2018 | Narayanaswamy | F21S 4/28 |

* cited by examiner

LINEAR LUMINAIRE

CROSS-REFERENCE TO RELATED APPLICATIONS

The present application is a continuation of U.S. application Ser. No. 16/876,873, titled "Linear Luminaire," having a filing date of May 18, 2020 which is based on and claims priority to U.S. Provisional Patent Application No. 62/849,399 titled "Linear Luminaire" having a filing date of May 17, 2019, the entire contents of which is incorporated by reference herein.

BACKGROUND

The present disclosure relates to a linear luminaire and more particularly, to a cover of the luminaire intended to limit unauthorized access to the luminaire. Typically, lights are mounted to a surface, such as the ceiling, using mounting assemblies that are visibly accessible from the exterior of the light. Likewise, many lights include covers over the light emitters that are secured to the light housing using visibly accessible fastening systems. These mounting assemblies and fastening systems also typically include fasteners that may be removed by anyone with a standard tool set. This makes it relatively easily for unauthorized users to either remove the cover and steal the lighter emitters, or remove the entire light. What is needed is a mounting system that makes it more difficult for unauthorized users to remove the light. What is also needed is a fastening system design to prevent unauthorized users from accessing the light emitters. Additionally, it may be beneficial for any such a mounting system or a fastening system to be at least partially hidden from plain view. Additionally, it may be beneficially for any such mounting system or fastening system to provide relatively easy access for authorized users.

SUMMARY

In one aspect, the present disclosure provides a luminaire including a housing, a light emitter supported by the housing, and a cover removably coupled to the housing, where the cover includes a lens substantially covering the light emitter. An end cap is removably coupled to the housing and positioned substantially flush with the lens. A coupling mechanism couples the end cap to the housing, where the end cap substantially covers the coupling mechanism while coupled to the housing.

In another aspect, the present disclosure provides a luminaire including a housing, a light emitter supported by the housing, and a cover removably coupled to the housing, where the cover includes a lens substantially covering the light emitter. A coupling mechanism extends from the housing, where the coupling mechanism is configured to receive a fastening member. An end cap is removably coupled to the coupling mechanism, where the end cap substantially covers the coupling mechanism and the fastening member when the end cap is coupled to the coupling member.

In another aspect, the present disclosure provides a luminaire including a housing, a light emitter supported by the housing, and a cover removably coupled to the housing, where the cover includes a lens substantially covering the light emitter and a side panel coupling the cover to the housing, and where the cover defining a cross-sectional profile. An end cap is coupled to the housing, where the end cap has a cross-sectional profile that is substantially flush with the cross-sectional profile of the cover. A coupling mechanism is coupled to the housing and coupled to the cover, where the coupling mechanism couples an the end cap to the housing, and where the end cap substantially covers the coupling mechanism while coupled to the housing.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the present disclosure relates to a low profile luminaire. The reduced footprint, as well as mating features between a cover and a lens, limit unauthorized access to a light emitter of the luminaire.

Figure 1:
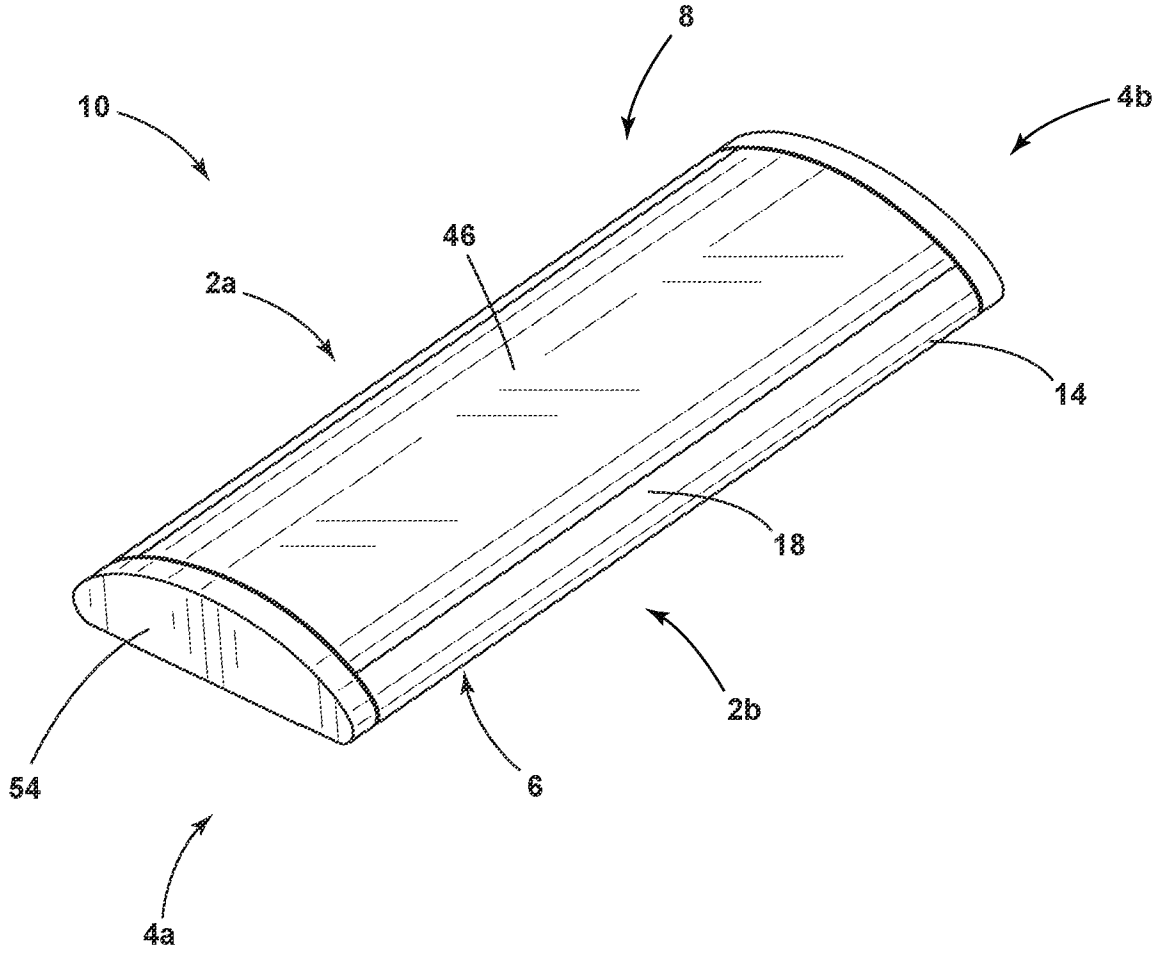
FIG. 1 is a perspective view of a luminaire according to one embodiment.
Figure 2:
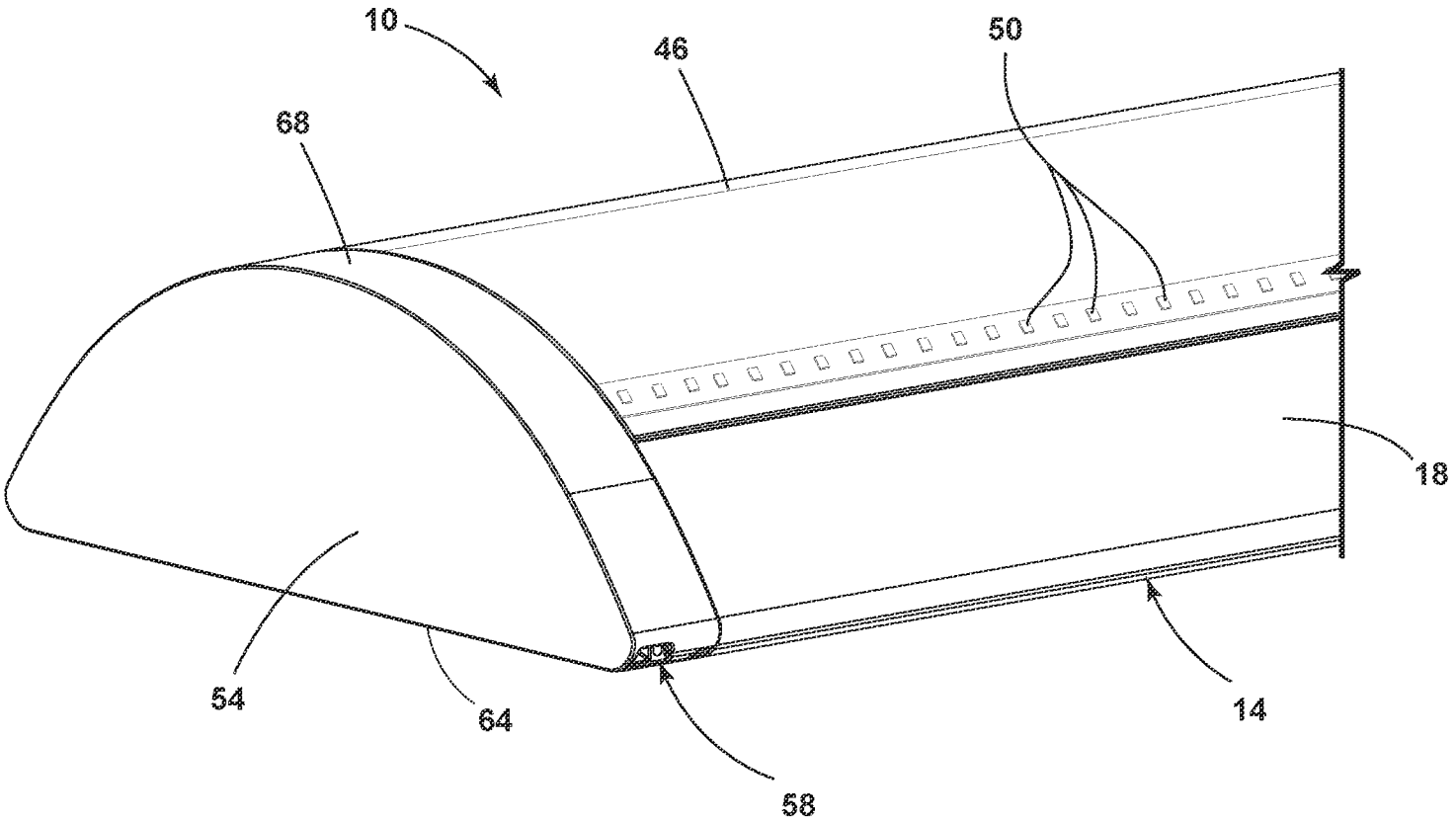
FIG. 2 is a detailed view of an end of the luminaire of FIG. 1.

As shown in FIGS. 1 and 2, a luminaire 10 has an elongated body defining a linear shape. In the illustrated embodiment, the luminaire 10 has a rectangular profile defined by opposing sides 2*a*, 2*b* extending in a lengthwise direction and opposing ends 4*a*, 4*b* extending in the widthwise direction. In the illustrated embodiment, the luminaire 10 has a generally flat back side 6 (facing downward in FIG. 1) and curved front side 8 (facing upward in FIG. 1) that follows an arcuate path.

In the illustrated embodiment, the front side 8 of the luminaire 10 is formed by a cover 14, which includes a lens 46 and a pair of side panels 18. The side panels 18 are oriented at an oblique angle relative to the backside 6 of the luminaire. Each side panel 18 extends in the lengthwise direction and is angled toward a middle of the cover 14 at substantially the same angle. The side panels 18 are also rounded or curved along an arcuate path. The cover 14 is coupled to a housing 20.

Figure 5:
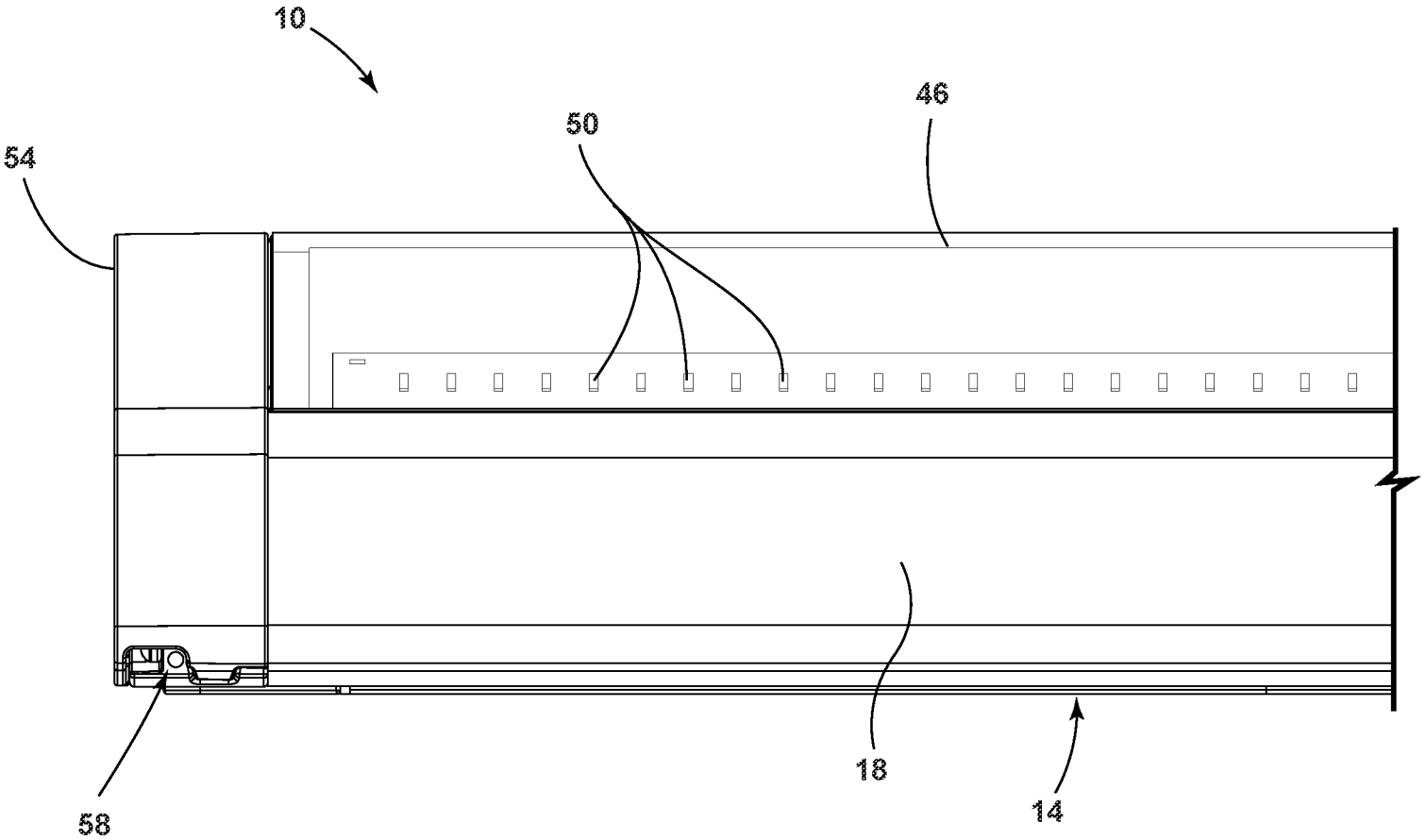
FIG. 5 is a side view of the luminaire of FIG. 1.

As shown in FIGS. 2 and 5, the lens 46 substantially covers light emitters 50 (e.g., light emitting diodes) supported behind the cover 14. In the illustrated embodiment, the lens 46 defines a curved or rounded profile with substantially the same radius of curvature as the pair of side panels 18. This allows there to be substantially no visible seam or transition between the lens 46 or between the side panels 18.

In the illustrated embodiment, the lens 46 is made from polycarbonate. This may protect the light emitters 50 covered by the lens 46. The lens 46 also provides a low glare and low pixilation to the light emitted by the light emitters 50 through the lens 46. However, the lens 46 may be made from a variety of different materials to achieve various desired characteristics such as strength, transparency, safety, etc.

Referring to FIGS. 3-4 and 10-11, the housing 20 includes a first or central housing member 22, second or mounting housing members 26, and third housing members or end cover members 30. The central housing member 22, shown separately in FIGS. 10 and 11, includes a rectangular profile and extends substantially along the length of the cover 14. A channel 34 extends substantially along a length of the central housing member 22. The central housing member 22 may include a plurality of rail systems for coupling the cover 14 to the housing 20. In the illustrated embodiment, the central housing member 22 includes a first rail system 24 extending along a first outside edge of the central housing member 22 and a second rail system 28 extending along a second outside edge of the central housing member 22. The first and second rail systems 24 and 28 may be used to couple the cover 14 to the central housing member 22. For example, the sides 18 of the cover 14 may engage with first and second rail systems 24 and 28. This is shown in the cross sectional view of the central housing member 22 and the cover 14 in FIG. 10. Additionally, the central housing member 22 may further include a third rail system 32 extending through a middle portion of the central housing member 22. The third rail system 32 may be used to couple interior components to the central housing member 22. For example, the light emitters 50 may be coupled to the central housing member 22 via the third rail system 32.

Figure 3:
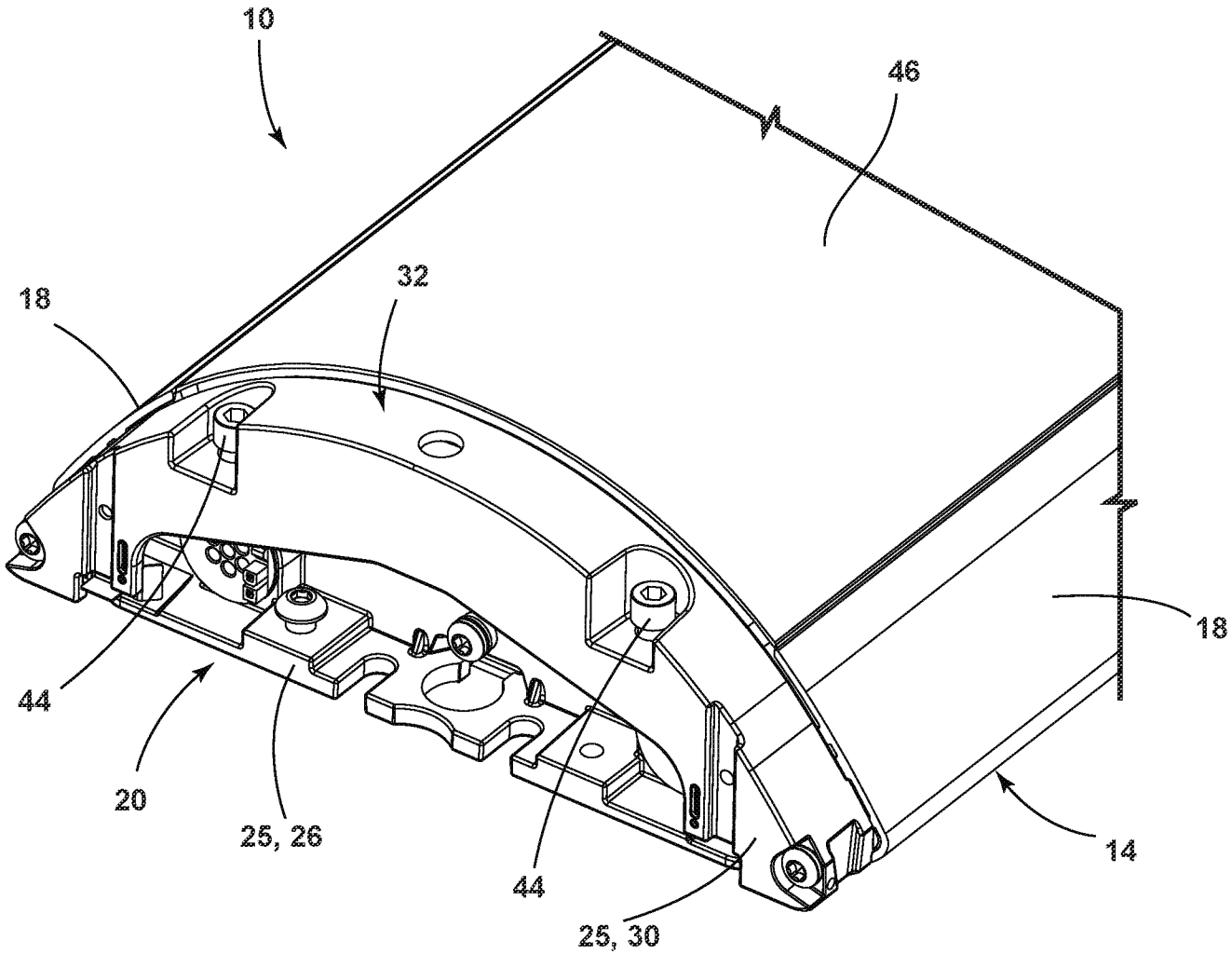
FIG. 3 is a perspective view of the luminaire of FIG. 1, with an end cap removed.
Figure 4:
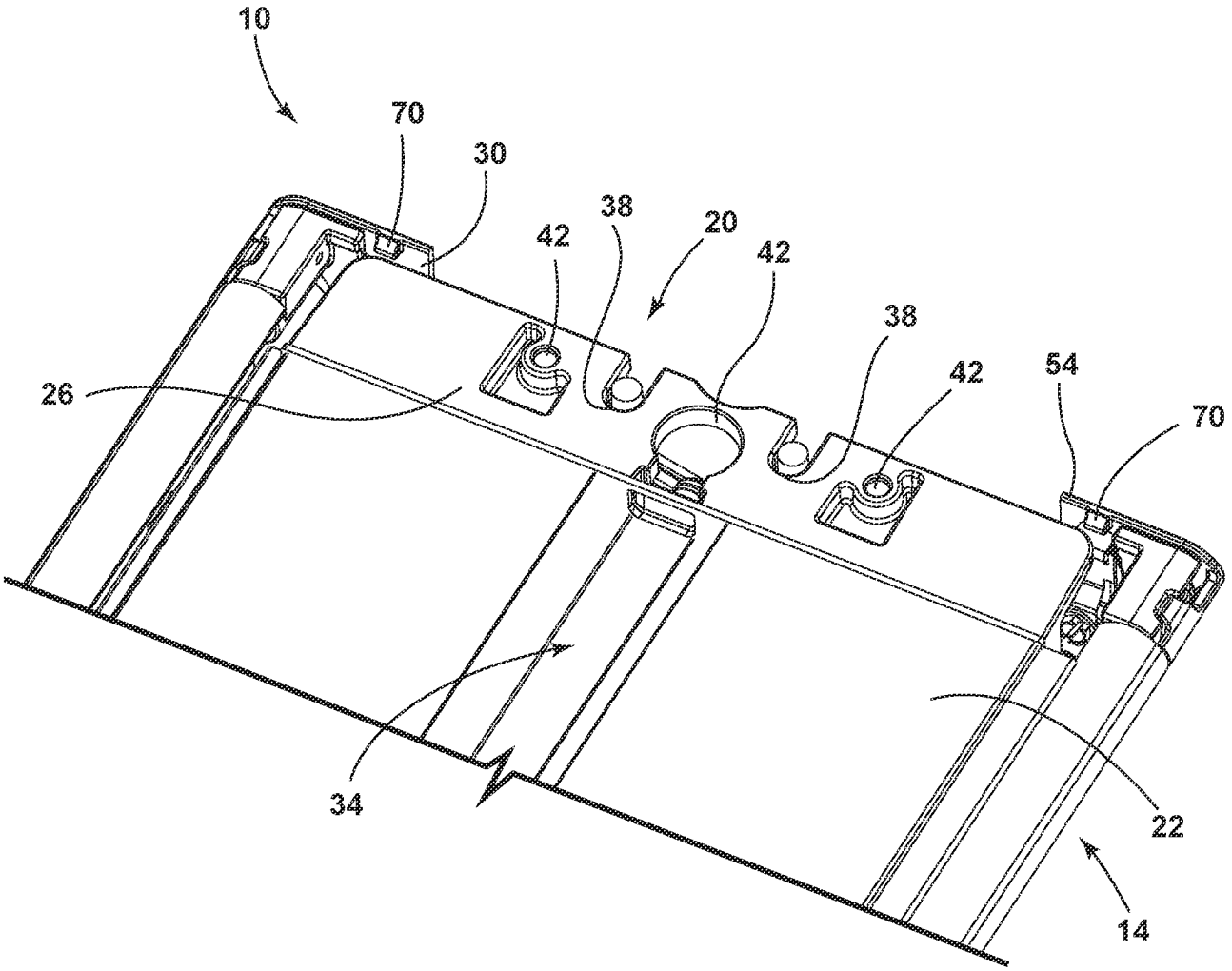
FIG. 4 is a bottom view of a portion of the luminaire of FIG. 1.
Figure 11:
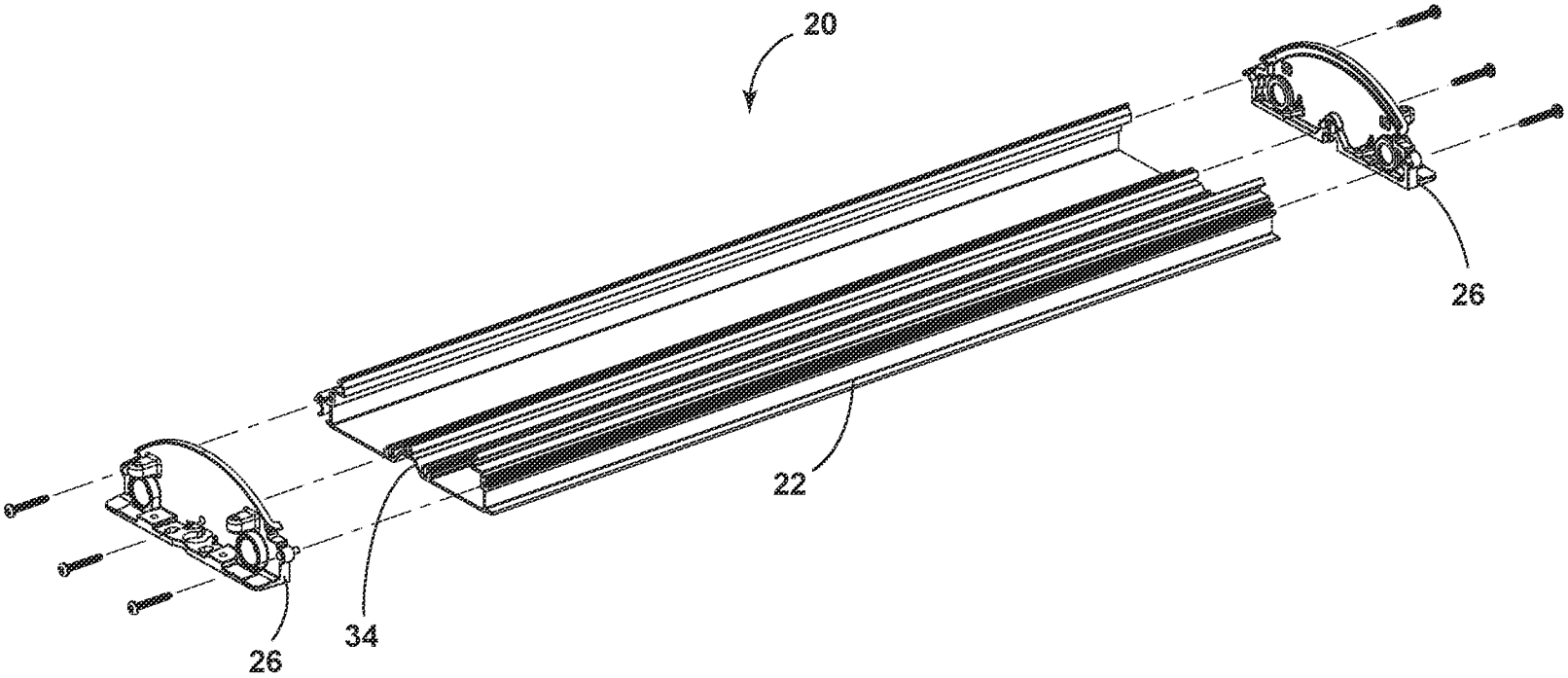
FIGS. 11-14 illustrate various assembly steps of the luminaire according to one embodiment.

Mounting housing members 26, are coupled to each end of the central housing member 22, as shown in FIG. 11. In the illustrated embodiment, the mounting housing members 26 extend beyond either end of the cover 14. As shown in FIGS. 3 and 4, each mounting housing member 26 includes one or more slot 38 positioned along the edge of the mounting housing member 26. The mounting housing member 26 further includes a plurality of apertures 42.

With continued reference to FIGS. 3 and 4, the end cover members 30 are coupled to each of the mounting housing members 26. The end cover members 30 also extend from an end of the cover 14. The end cover members 30 include a curved top side 32 that shares a similar radius of curvature as the cover 14. More specifically, in the illustrated embodiment, the lens 46 and the side panels 18 together define substantially the same profile as the end cover member 30. Each end cover member 30 covers the respective mounting housing member 26, and extends beyond an end of the mounting housing member 26. As shown in FIG. 3, fastening members 44 (e.g., tamper resistant screws) are coupled to the end cover member 30 in order to couple the end cover member 30 to the rest of the housing 20 (e.g., the mounting housing member 26). In some embodiments, the fastening members 44 include a cap or a sleeve to help prevent the fastening members 44 from falling during installation of the luminaire 10.

The mounting housing members 26 and the end cover members 30 act as housing coupling mechanisms 25 by coupling the end caps 54 to the central housing member 22. In the illustrated embodiment, the central housing member 22, the mounting housing members 26, and the end cover members 30 are formed as separate elements. However, in other embodiments, one or more of the central housing member 22, the mounting housing members 26, and the end cover members 30 may be formed as a single unitary member. For example, in some embodiments, a mounting housing member 26 and an end cover member 30 may be formed as a single unitary element. Similarly, in some embodiments, the mounting housing members 26 and the central housing member 22 may be a formed as a unitary body.

Figure 14:
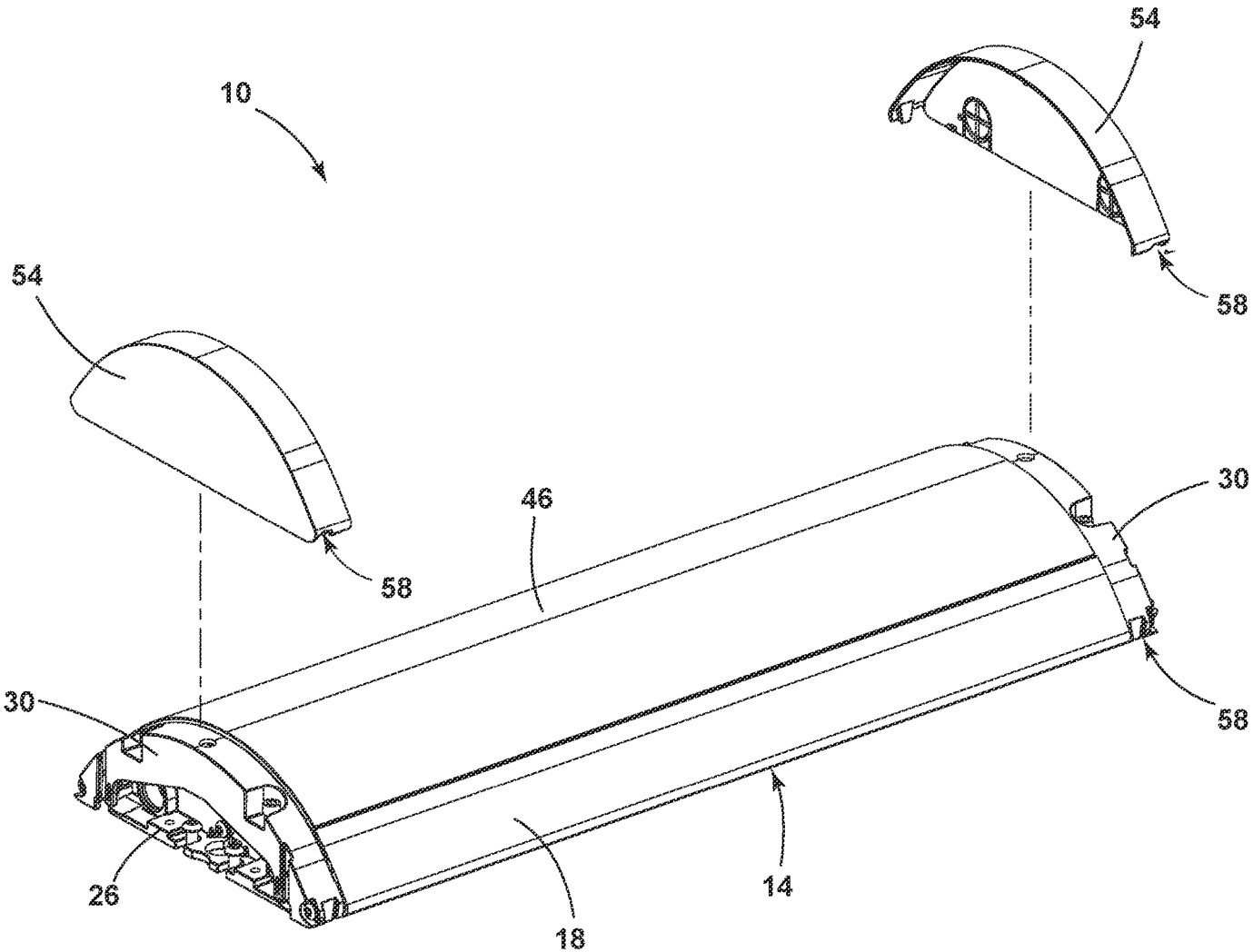

As shown in FIGS. 2 and 14, end caps 54 are removably coupled to the end cover members 30. The end caps 54 completely cover the respective end cover members 30 in order to conceal the hardware used to assembly and mount the luminaire 10. For example, the end caps 54 extend over the top side 32 of the end cover members 30 and extend towards the lens 46 and the side panels 18. The lens 46 is positioned adjacent to the end caps 54, so that the end caps and lens 46 are substantially flush with one another. The end caps 54 are also substantially flush with the side panels 18. As shown in FIG. 2, the end caps 54 include a first portion 64 that is substantially flat, and a second portion 68 that is curved. The first portion of the end cap faces the support surface C (FIG. 6) upon which the luminaire 10 is mounted. Second portions 68 of the end caps 54 have substantially the same radius of curvature as the cover 14 so that the end caps 54 and the cover 14 are flush with one another along the entire width of the cover 14. This means that there is substantially no seam or visible transition between the end caps 54 and the lens 46 or the cover 14.

An aperture 58 (e.g., a keyhole) is positioned on the end cap 54 and extends entirely through the end cap 54 and the cover member 30. The aperture 58 is positioned in a location of the end cap 54 that is not visible when the luminaire 10 is mounted to the support surface C. For example, as shown in FIG. 2, the aperture 58 is positioned proximate the corners of the end cap where the first portion meets 64 the second portion 68 of the end cap. Accordingly, the aperture 58 is generally concealed when the luminaire 10 is mounted to the support surface C. As will be described in greater detail below, the aperture 58 provides a means by which a tool can be inserted into the end cap 54 to release the end caps 54 from the cover members 30.

In the illustrated embodiment, the end caps 54 are die cast and are opaque. In other words, light emitted by the light emitters 50 may only escape the luminaire 10 through the lens 46, and not through the end caps 54. In other embodiments, the end caps 54 may be formed in a different manner, and/or may allow light to pass through.

Figure 6:
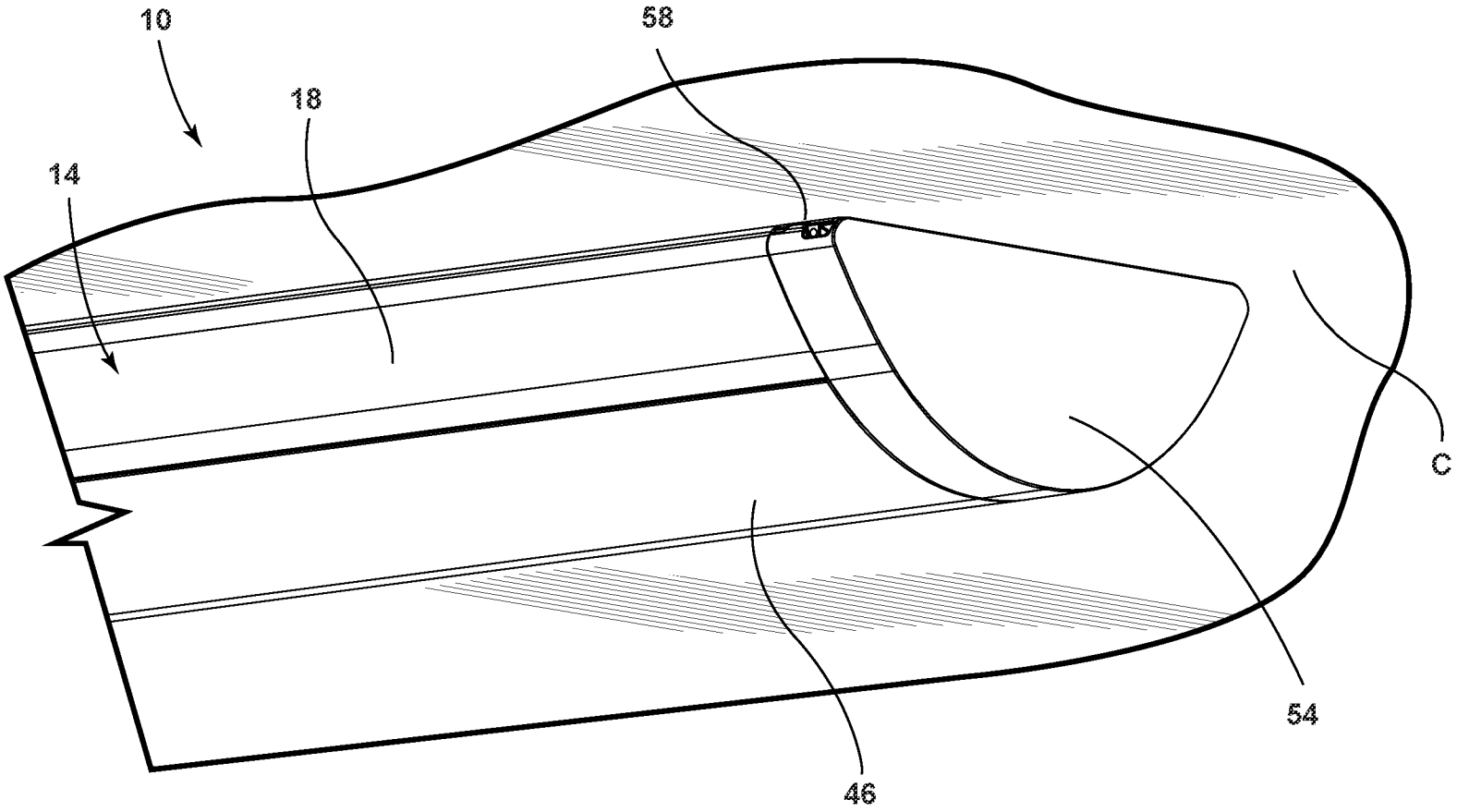
FIG. 6 is a perspective view of the luminaire of FIG. 1 coupled to a support surface.
Figure 7:
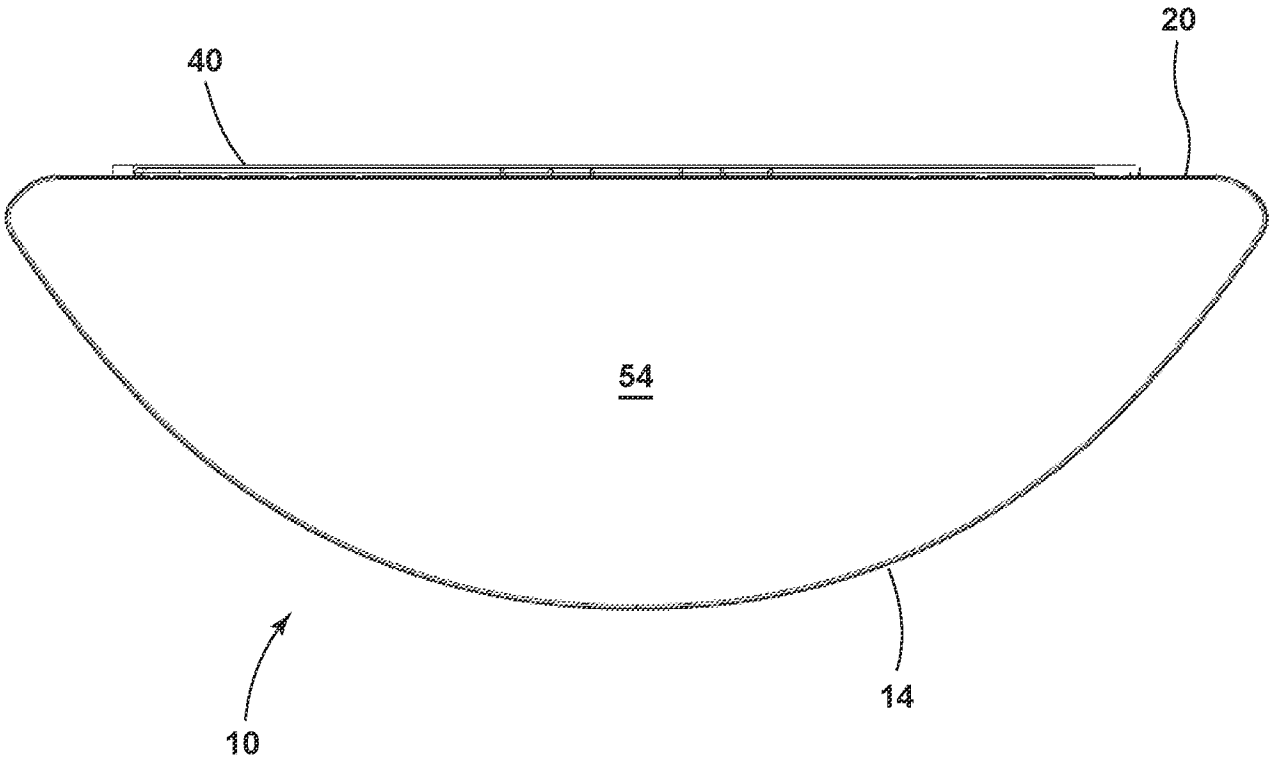
FIG. 7 is an end view of the luminaire of FIG. 1.

As shown in FIGS. 6 and 7, the fully assembled luminaire 10 is coupled to a support surface C (e.g., a ceiling) so that the lens 46 extends away from the ceiling. Fastening members (not shown) may be inserted through the slots 38 of the mounting housing members 26 in order to couple the luminaire 10 to the support surface C. In some embodiments, a bracket 40 (FIG. 7) may be used to couple the luminaire 10 to a support surface C. In this embodiment, a longitudinal surface of the housing 20 may extend below a longitudinal surface of the bracket 40. The longitudinal surface of the bracket 40 is coupled to the support surface C, while the housing 20 is spaced apart from the support surface C (e.g., by 0.05 inches). Spacing the housing 20 away from the support surface C may ensure the luminaire 10 conforms to building standards.

In some embodiments, sensors (not shown) may be coupled to the luminaire 10, and control various aspects of the luminaire 10. For example, the luminaire 10 may include an occupancy sensor to control when the light emitters 50 are activated, or ON. The luminaire 10 may also be controlled using wireless controllers (e.g., a remote controller, a cell phone, etc.) in order to control the light emitters 50 (e.g., a color of the emitted light, a brightness of the emitted light, etc.). The light emitters 50 may also be capable of emitting high-intensity narrow-spectrum (HINS) light. The sensors may be coupled to the mounting housing member 26 using the apertures 42 (See, e.g., FIG. 4).

Figure 15:
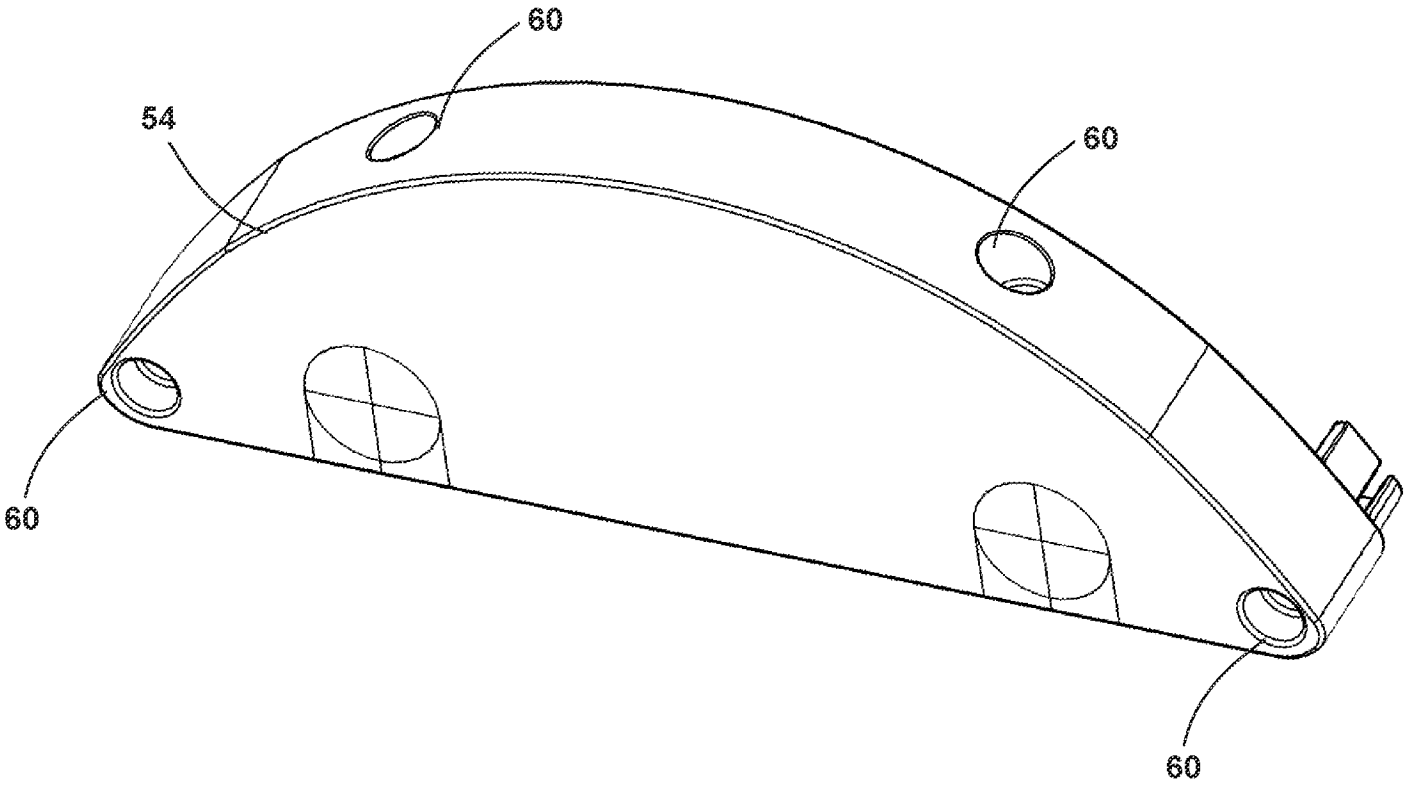
FIG. 15 illustrates an embodiment of an end cap.

While coupled to the support surface C, the luminaire 10 limits or prevents unauthorized access (e.g., by vandals). The luminaire 10 includes no visible coupling mechanisms 25 or coupling members (e.g., fasteners, latches, etc.) which can be used to disassemble the luminaire 10. The luminaire 10 also includes no exposed hardware components (e.g., light engines, controllers, etc.) in order to further protect the luminaire 10. However, in other embodiments of an end cap 54, only selected coupling members may be visible. For example, in the embodiment shown in FIG. 15, through-holes 60 are provided to align with the selective coupling members that are desired to be visible or accessible without removing the end cap 54. In this embodiment, the through-holes 60 in the end cap 54 are aligned with fasteners 44 to allow the fasteners 44 to be accessed directly. The end cap 54 conceals all other coupling members and hardware.

To further limit or prevent unauthorized access, the luminaire 10 has a low profile, and generally includes a small width (e.g., between the side panels 18) and a small depth (e.g., between the lens and the housing 20). In the illustrated embodiment, the width and depth are both approximately 3 inches. In other embodiments, either dimension may be larger or smaller (e.g., 8 inches). These small dimensions position the luminaire 10 closer to the support surface C, making access more difficult. The small dimensions also make the luminaire 10 compact, and reduces an external surface area that could be tampered with.

The lack of external or visible coupling mechanisms 25 makes accessing an interior of the luminaire (e.g., inside of the cover 14) more difficult, and adds security to the luminaire 10. When the luminaire 10 is coupled to the support surface C, the aperture 58 is positioned to face the support surface C. In other words, a user will typically be unable to see the aperture 58 while standing in a room with the luminaire 10.

Returning to FIG. 4, latches 70 are secured to each end cover member 30 and engage the respective end cap 54. The latches 70 are completely hidden from view while the luminaire 10 is coupled to the support surface C. In order to actuate the latches 70 and remove the end caps 54 from the housing 20, the user may insert a tool (not shown) into the aperture 58. The tool may pry one of the latches 70 away from the surface of the end cap 54 so that the end cap 54 can then be removed from the housing 20. In accordance with a further embodiment, latch 70 has a unique shape and the tool used to pry the latch from the surface of end cap 54 is further uniquely shaped to mate with the latch, making operation of the latch 70 yet even more difficult unless the uniquely shaped tool is used.

Returning to FIG. 3, the end cover member 30 is exposed after the end cap 54 is removed. Removing the end cap 54 also exposes the fastening members 44. In the illustrated embodiment, the fastening members 44 have a screw head that limits unauthorized movement (e.g., a unique shape) by requiring a specialized tool in order to rotate the fastening members 44 relative to the respective end cover member 30. This provides additional security to the luminaire because the fastening members 44 make unauthorized access of the remainder of the housing 20 more difficult. Specifically, it may be more difficult to access the mounting housing members 26, and uncoupled the luminaire 10 from the support surface C.

Figure 10:
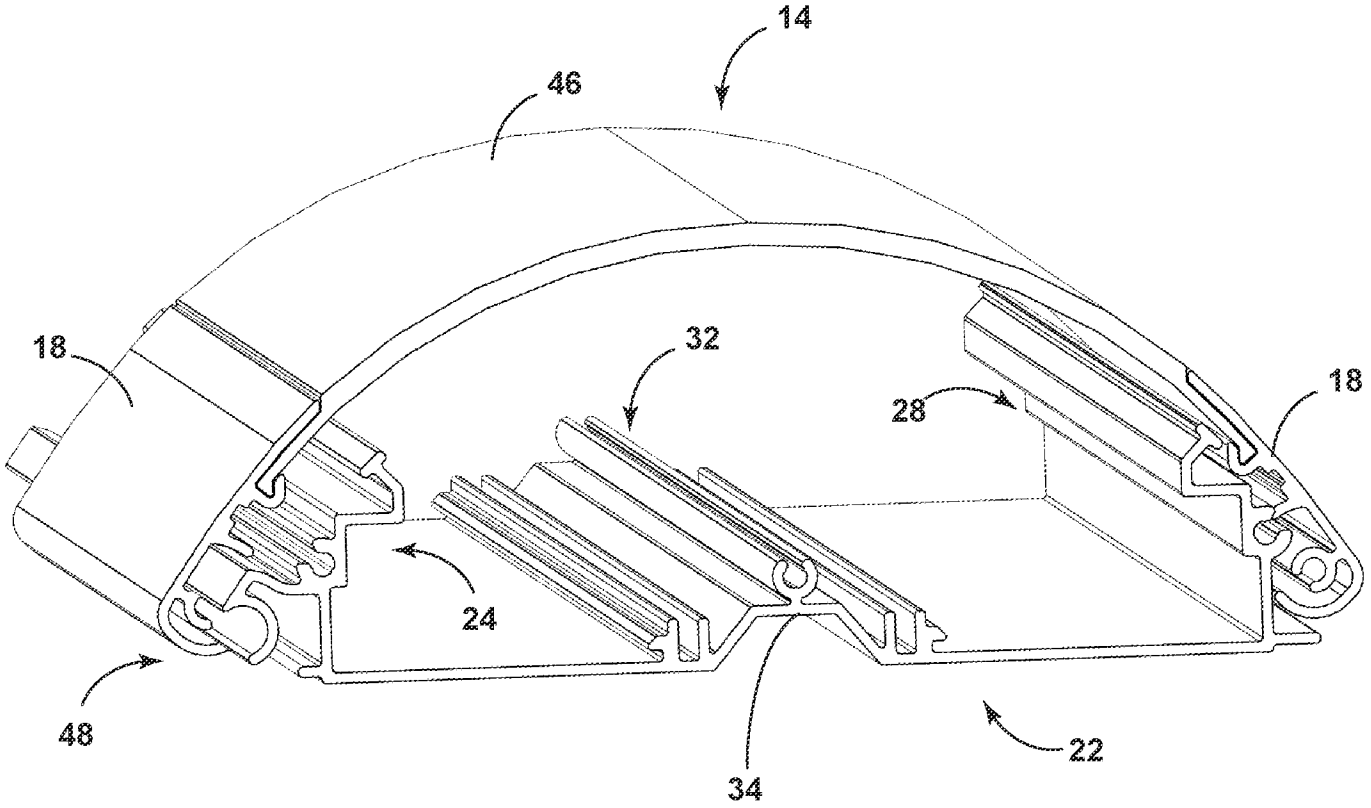
FIG. 10 is a cross-sectional view of a central housing member and a cover according to one embodiment.
Figure 13:
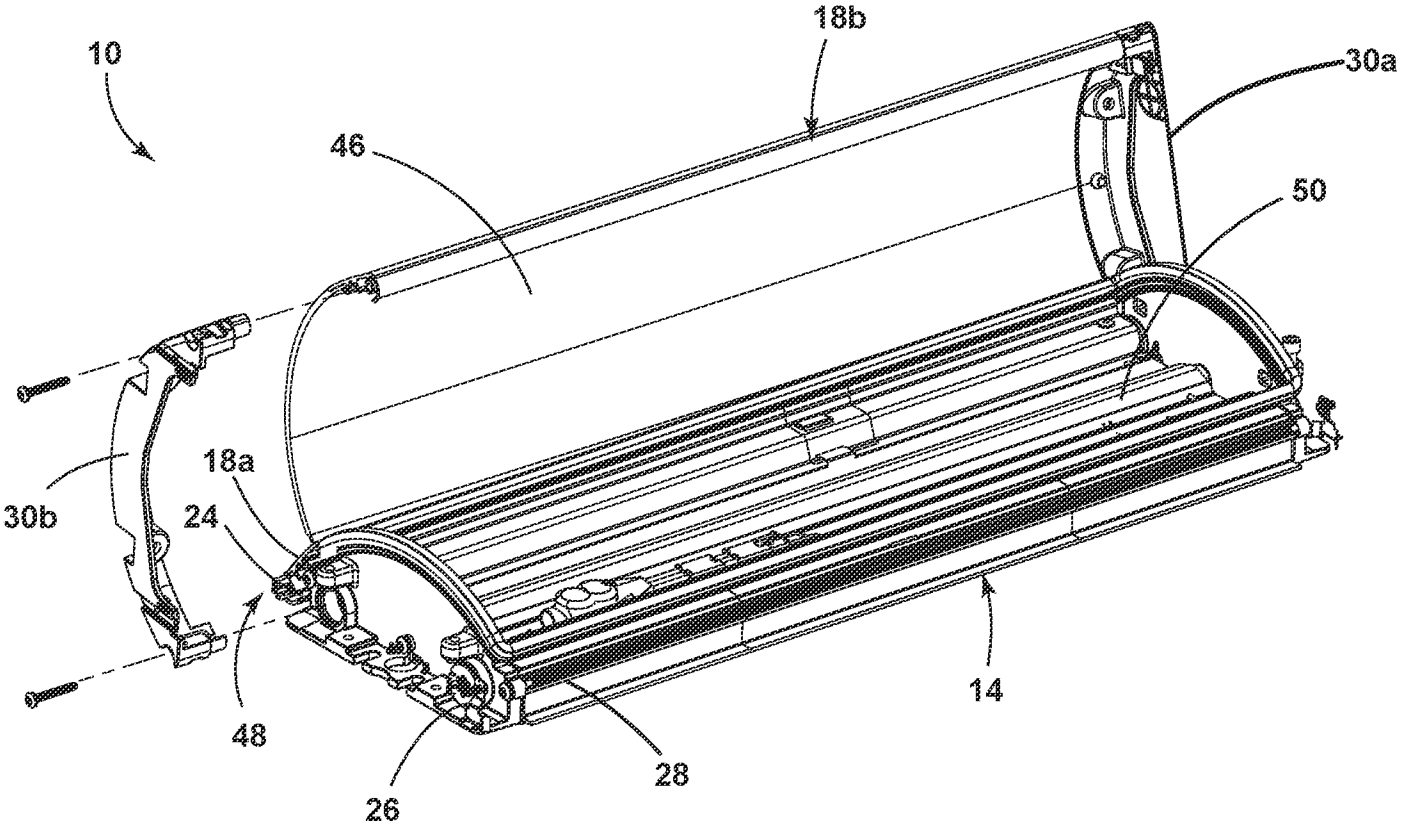

Referring to FIGS. 10 and 13, the cover 14 may be coupled to the housing 20 by a hinge assembly 48. The hinge assembly 48 enables the cover 14 to relate relative to the housing 20 and provide access to the components behind the cover 14 in order to service and maintenance the components of the luminaire 10 (e.g., the light emitters 50).

Figure 8:
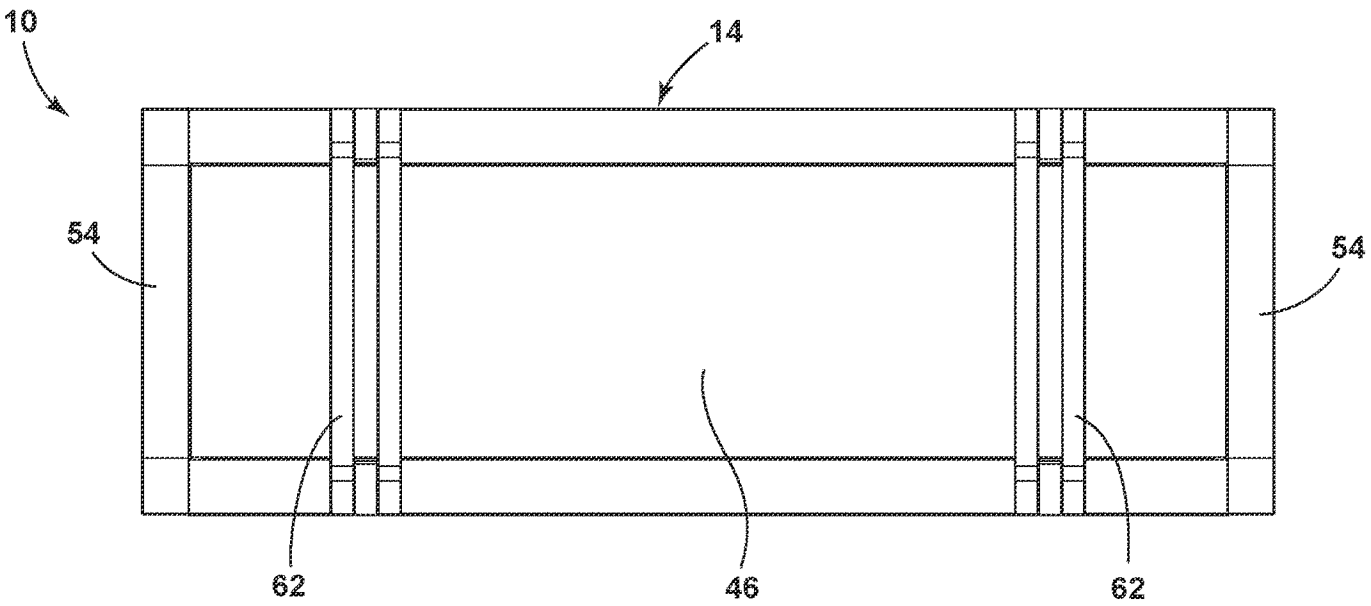
FIG. 8 is a front view of the luminaire of FIG. 1 with a retainer coupled to a cover.
Figure 9:
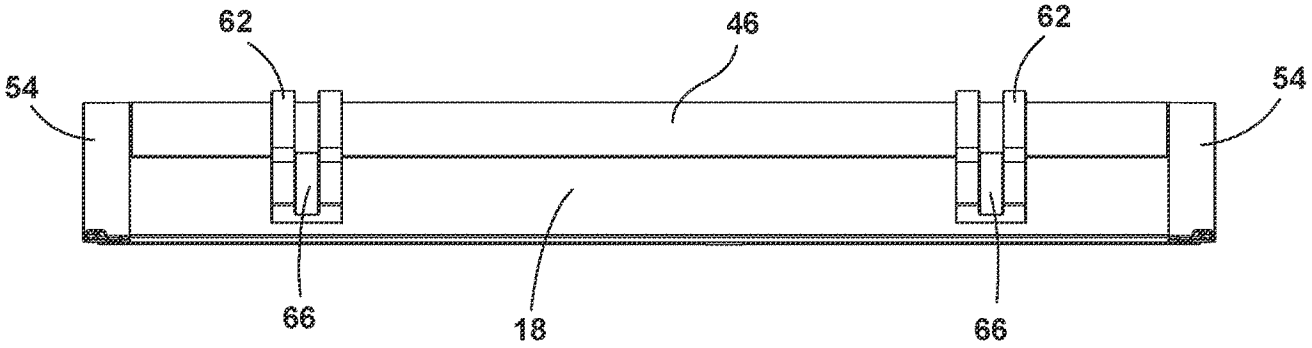
FIG. 9 is a side view of the luminaire of FIG. 1 with a retainer coupled to the cover.

Additionally, as shown in FIGS. 8 and 9, in some embodiments, the luminaire 10 may also include a retainer 62 that further limits access to the light emitters 50 (i.e., limits removal of the lens 46). In the illustrated embodiment, the retainer 62 is a band that extends across the surface of the lens 46. The cover 14 includes a fastener 44 (see e.g., FIG. 8) on either side panel 18 in order to couple the retainer 62 to the cover 14. The luminaire 10 may include any number of retainers 62. The retainers 62 may be elastomeric, or may be formed from any other material. The retainers 62 may also serve to increase an aesthetic of the luminaire 10 and/or light emitted by the light emitters 50.

Figure 12:
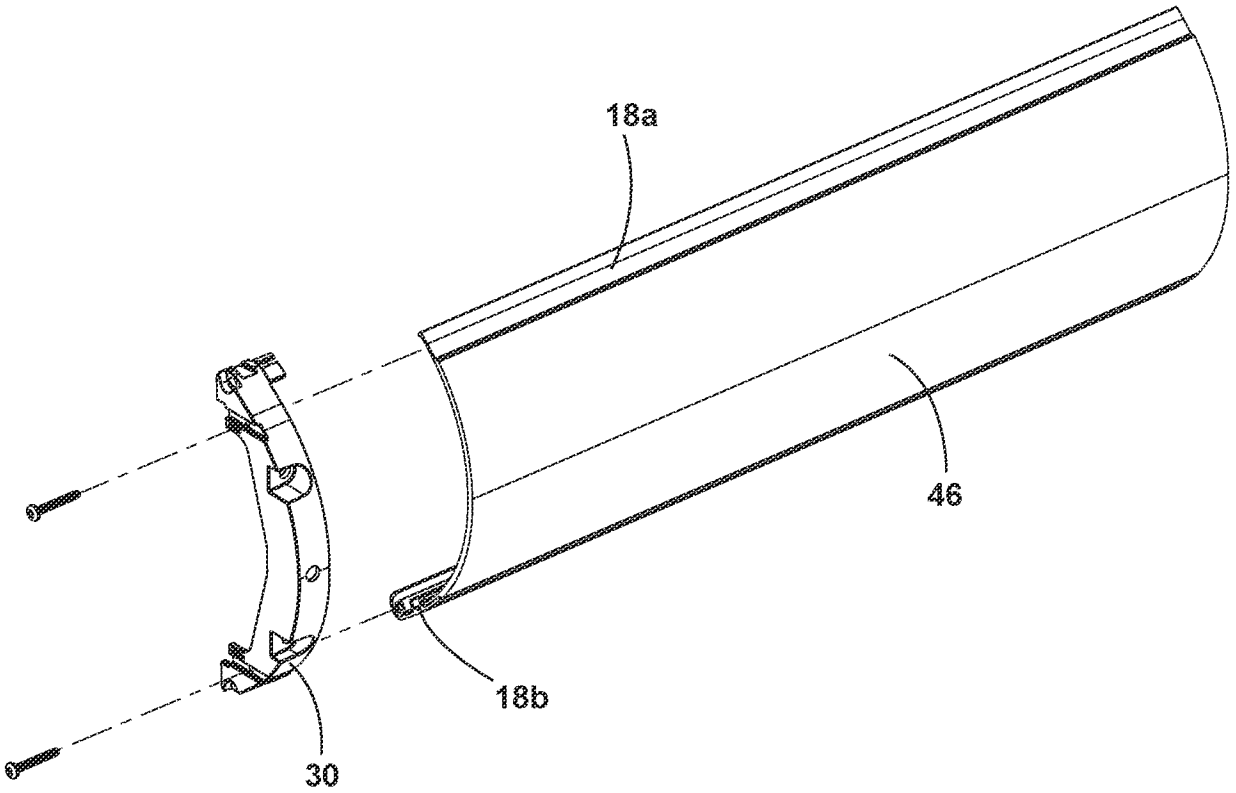

As one exemplary embodiment, the luminaire 10 may be assembled as shown in FIGS. 11-14. The mounting housing members 26 are coupled to each end of the central housing member 22 (FIG. 11). The mounting housing members 26 may be secured by fasteners, such a screws. Referring to FIG. 12, the cover 14 is assembled by sliding first and second side panels 18*a* and 18*b* onto each side of the lens 46. A first end cover member 30*a* is then coupled to one end of the cover 14. The end cover member 30 may be coupled to the cover 14 by a fastener, such as a screw.

As shown in FIG. 13, the cover 14 with the first end cover member 30*a* coupled thereto may be coupled to the central housing member 22 by sliding the first side panel 18*a* along the first rail system 24. Once the cover member 14 and the first end cover member 30*a* are slide relative to the central housing member 22 such that the first end cover member 30*a* reaches an end of the central housing member 22, the second end cover member 30*b* may be coupled to the cover 14. Specifically, the second end cover member 30*b* is coupled to the end of the cover 14 opposite the first end cover member 30*a*.

The cover 14 and the two end cover members 30*a* and 30*b* may then be rotated relative to the central housing member 22, and the second side panel 18*b* may be engaged with the second rail system 28 to secure the cover 14 to the central housing member 22. Additionally, fastener members 44 are inserted through the end cover members 30*a* and 30*b* to secure the end cover members 30*a* and 30*b* to the mounting housing members 26. Finally, the end caps 54 are slide over the end cover members 30*a* and 30*b* to conceal the hardware and create a finished look of the luminaire 10. As will be understood by a person of ordinary skill in the art, one or more of the described assembly steps may be executed in a different order.

Although aspects have been described in detail with reference to certain preferred embodiments, variations and modifications exist within the scope of one or more independent aspects as described.

The invention claimed is:

1. A luminaire, comprising:

a housing;

a light emitter supported by the housing;

a cover removably coupled to the housing, the cover including an end cover member;

an end cap removably coupled to the end cover member, the end cap including an aperture providing access to the end cover member and substantially covering the end cover member while coupled to the end cover member.

2. The luminaire of claim 1, further comprising:

a lens covering the light emitter and retained by the cover.

3. The luminaire of claim 2, further comprising;

a fastening member disposed in the end cover member and coupling the end cover member to the housing.

4. The luminaire of claim 1, wherein the aperture is positioned at a location of the end cap that is concealed while the luminaire is mounted to a support surface.

5. The luminaire of claim 1, wherein the luminaire is defined by a depth of three inches and a width of 3 inches.

6. The luminaire of claim 1, wherein the end cover member includes a latch that engages the end cap, and wherein the aperture is aligned with the latch to provide access to the latch.

7. The luminaire of claim 1, wherein the end cover member includes a fastener that engages the end cap, and wherein the aperture is aligned with the fastener to provide access to the fastener.

8. The luminaire of claim 1, wherein the housing comprises a mounting housing member configured to mount the luminaire to a support surface, and wherein the end cap is additionally removably coupled to and substantially covers the housing mounting member.

9. The luminaire of claim 1, wherein the cover is curved along an arcuate path having a radius of curvature, and wherein the end cap has a curved profile with substantially the same radius of curvature as the cover.

10. A product, comprising:

a coupling mechanism configured to be attached to a housing and lens of a luminaire;

a fastener configured to fasten the coupling mechanism to the housing;

an end cap configured to be removably coupled to the coupling mechanism, the end cap substantially covering the coupling mechanism while coupled to the coupling mechanism; and, an aperture in the end cap, the aperture providing access to the coupling mechanism while the end cap is coupled to the coupling member.

11. The product of claim 10, wherein the coupling mechanism comprises an end cover member, configured to be fastened to a side panel of a cover of the luminaire and the housing.

12. The product of claim 10, wherein the coupling mechanism comprises a housing mounting member configured to be fastened to the housing and to mount the housing to a support surface.

13. The product of claim 10, wherein the aperture is positioned at a location of the end cap that is concealed while the housing is mounted to a support surface.

14. The product of claim 10, further comprising a lens attached to the coupling mechanism.

15. The product of claim 14, further comprising a cover engaging the coupling mechanism and the lens, and configured to be fastened to the housing.

16. An end cap configured to be removably coupled to a coupling member of a luminaire, the end cap comprising an aperture, designed for a tool to be inserted, that provides a sole point of access to the coupling member while the end cap is coupled to the coupling member.

17. The end cap of claim 16, wherein the coupling member includes a latch that engages the end cap, and wherein the aperture is aligned with the latch to provide access to the latch.

18. The end cap of claim 16, wherein the coupling member includes a fastener that engages the end cap, and wherein the aperture is aligned with the fastener to provide access to the fastener.

* * * * *